US006368264B1

(12) United States Patent
Phillips et al.

(10) Patent No.: US 6,368,264 B1
(45) Date of Patent: Apr. 9, 2002

(54) CENTRIFUGE CONTROL SYSTEM AND METHOD WITH OPERATION MONITORING AND PUMP CONTROL

(75) Inventors: Victor Phillips, Littleton, CO (US); Che-Liang Chang, Edmond; Troy Martin, Oklahoma City, both of OK (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 09/536,198

(22) Filed: Mar. 27, 2000

Related U.S. Application Data

(60) Provisional application No. 60/126,744, filed on Mar. 29, 1999.

(51) Int. Cl.[7] ..... B04B 11/00

(52) U.S. Cl. ..... 494/5; 494/30; 494/42

(58) Field of Search ..... 494/1, 5, 7–10, 494/12, 27, 30, 37, 42, 52–54, 82–84; 210/97, 103, 134, 143, 144, 380.3

(56) References Cited

U.S. PATENT DOCUMENTS

| | | | | | |
|---|---|---|---|---|---|
| 3,228,594 | A | * | 1/1966 | Amero | 494/53 |
| 3,494,542 | A | * | 2/1970 | Craig et al. | 494/7 |
| 3,532,264 | A | * | 10/1970 | Amero | |
| 4,070,290 | A | * | 1/1978 | Crosby | 494/8 |
| 4,129,249 | A | * | 12/1978 | Todd | |
| 4,141,488 | A | * | 2/1979 | Gense | |
| 4,228,949 | A | * | 10/1980 | Jackson | 494/84 |
| 4,240,578 | A | * | 12/1980 | Jackson | 494/1 |
| 4,299,353 | A | * | 11/1981 | Bruning et al. | 494/8 |
| 4,303,192 | A | * | 12/1981 | Katsume | |
| 4,369,915 | A | * | 1/1983 | Oberg et al. | 494/8 |
| 4,411,646 | A | * | 10/1983 | Cyphelly | 494/84 |
| 4,421,502 | A | * | 12/1983 | Jakobs | 494/7 |
| 4,432,747 | A | * | 2/1984 | Posse et al. | 494/9 |
| 4,668,213 | A | * | 5/1987 | Kramer | 494/8 |
| 5,203,762 | A | * | 4/1993 | Cooperstein | 494/7 |
| 5,403,260 | A | * | 4/1995 | Hensley | 494/53 |
| 5,529,566 | A | | 6/1996 | Weil | |
| 5,681,256 | A | * | 10/1997 | Nagafuji | 494/9 |
| 5,857,955 | A | | 1/1999 | Phillips et al. | |
| 5,919,123 | A | * | 7/1999 | Phillips | 494/84 |

FOREIGN PATENT DOCUMENTS

| | | | | |
|---|---|---|---|---|
| DE | 2358803 | * | 6/1975 | 494/7 |
| DE | 2709569 | * | 10/1977 | 494/7 |
| DE | 3005658 | * | 10/1981 | 494/8 |
| GB | 2099334 | * | 12/1982 | 494/53 |
| JP | 53091465 | | 11/1978 | |
| JP | 63-116762 | * | 5/1988 | 494/7 |
| JP | 04371244 | | 12/1992 | |
| WO | WO 97/20634 | | 6/1997 | |

OTHER PUBLICATIONS

Abstract for Japan 53–91465. Aug. 1978.*

* cited by examiner

*Primary Examiner*—Charles E. Cooley
(74) *Attorney, Agent, or Firm*—Haynes & Boone, LLP

(57) ABSTRACT

A system and method for controlling a centrifuge which receives a mixture of liquid and solid particles and separates the liquid from the solid particles. A bowl, along with a conveyor extending inside the bowl, are rotated and the speed of, and the torque applied to, the bowl and the conveyor are detected and corresponding output signals are generated. A variable speed drive pump is provided for pumping the flow of the mixture to the centrifuge. A computer responds to the output signals and controls the speed of the bowl and the conveyor as well as the operation of the pump to attain predetermined optimum operating conditions of the centrifuge.

10 Claims, 1 Drawing Sheet

CENTRIFUGE CONTROL SYSTEM AND METHOD WITH OPERATION MONITORING AND PUMP CONTROL

CROSS-REFERENCE TO RELATED APPLICATION

This application relates to, and claims priority of, provisional application Ser. No. 60/126,744 filed Mar. 29, 1999.

BACKGROUND

The present invention relates to a centrifuge control system and method and, more particularly, to a control system and method for controlling the operation of a decanting centrifugal separator in response to variations in several operating parameters.

Decanting centrifuges are well known in the art and are designed to process a mixture of two constituents, usually a liquid and a solid, and to separate one from the other. These types of centrifuges feature a rotating bowl and a spiral screw conveyer disposed inside the bowl which rotates in the same direction as the bowl and at a different speed. The mixture, which for the purpose of example, will be assumed to be a liquid having relative fine solid particles entrained therein, enters the bowl and the centrifugal forces direct and hold it against the inner wall of the bowl in a "pool" while the fluid is displaced to one end portion of the bowl for discharge. The solid particles settle against the wall and are transported, or displaced, by the screw conveyor to discharge ports extending through the opposite end portion of the bowl for discharge. Typical applications of this type of centrifuge is in pulp, paper, and waste water treatments and for the removal of dirt, sand, shale, abrasive cuttings, and/or silt particles (hereinafter referred to as "solid particles") from drilling fluid after the fluid has been circulated through a drilling bit to lift the cuttings to the surface in an oil field drilling operation.

However, there are several parameters involved in the operation of a centrifuge, such as bowl speed and torque, conveyor speed and torque, fluid pump rate, fluid viscosity or dilution, and fluid solids content and properties. Since the operational goals of the centrifuge itself are fairly precise, it is important that the centrifuge be controlled so that its operation is optimized in response to variations in the above parameters. Also, the centrifuge itself can be operated in different modes in accordance with different design goals, such as maximum solids separation, maximum solids discard volume, etc., which requires further precise control. Therefore, the centrifuge should be controlled in a manner so that precise predetermined operational modes can be maintained despite variations in the various operational parameters and design goals. Such a control system and related method are disclosed in U.S. Pat. No. 5,857,955, assigned to the assignee of the present application. Although this system is eminently successful in maintaining precise predetermined operational modes despite variations in the various operational parameters and design goals it is difficult to insure that the density of the mixture is within a predetermined acceptable range which is important to avoid excessive loading of the conveyor and/or the bowl. Also, it would be advantageous if the system disclosed in the above patent would react much more quickly and efficiently to changes in the properties of the fluid stream entering the centrifuge, and if the mass rate and density of the separated fluid discharging from the bowl could be estimated.

SUMMARY

The present invention, accordingly, provides a system and a method for controlling a centrifuge system including a rotatable bowl and a rotatable screw conveyor extending in the bowl. A variable speed drive pump pumps a mixture of liquid and solid particles to the bowl and two drive assemblies respectively rotate the bowl and the conveyor to separate the solids from the liquids. A computer is connected to the drive assemblies and to the pump for receiving signals from the drive assemblies based on the rotation of the bowl and or the conveyor and for sending signals to the pump to control the volume of mixture pumped from the pump to the bowl.

As a result, major advantages are achieved with the system and method of the present invention. For example, the computer will process the above signals and control the drive units for the pump, to insure that the density of the mixture is within a predetermined acceptable range. Also, this automatic control of the bowl and the conveyor in conjunction with automatic control of the pump will enable the system to react much more quickly and efficiently to changes in the properties of the fluid stream entering the centrifuge. Also, the computer can be provided with software to enable it to estimate the mass rate and density of the separated fluid discharging from the bowl.

DESCRIPTION OF A PREFERRED EMBODIMENT

Figure 1:
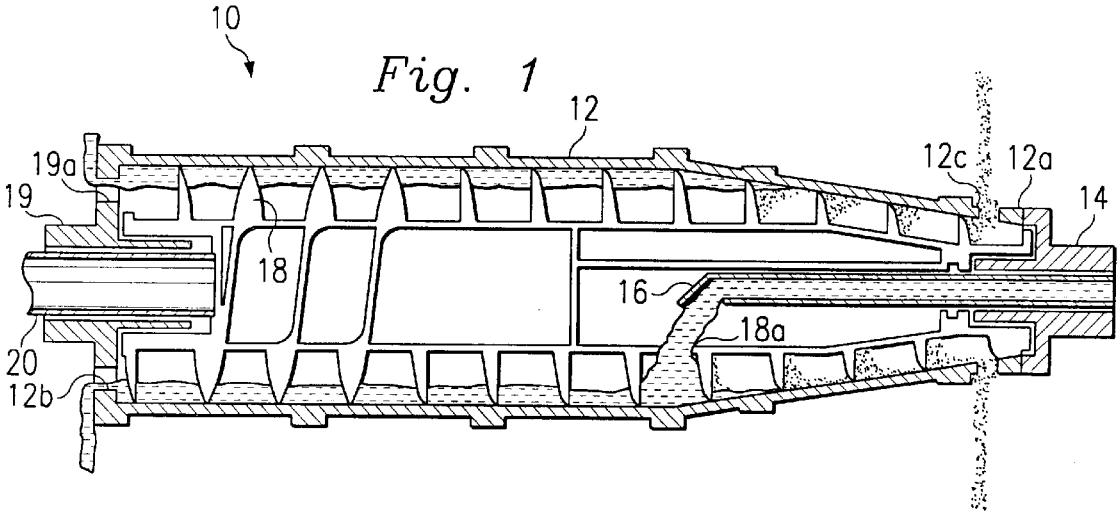
FIG. 1 is a sectional view of a centrifuge which is controlled by the system and method of the present invention.

Referring to FIG. 1 of the drawings, the reference numeral 10 refers in general, to a centrifuge the operation of which is controlled by the system, and according to the method, of an embodiment of the present invention. The centrifuge 10 includes an elongated bowl 12 supported for rotation about its longitudinal axis. The bowl 12 has two open ends 12*a* and 12*b*, with the open end 12*a* receiving a drive flange 14 which is connected to a drive shaft (not shown in FIG. 1) for rotating the bowl. A longitudinal passage extends through the drive flange 14 for receiving a feed tube 16 for introducing a feed slurry which, for the purposes of example, is a mixture of fluid and disbursed solid particles, into the interior of the bowl 12.

A screw conveyor 18 extends within the bowl 12 in a coaxial relationship thereto and is supported for rotation within the bowl in a manner to be described. To this end, a hollow flanged shaft 19 is disposed in the end 12*b* of the bowl and receives a drive shaft 20 of an external planetary gear box (not shown in FIG. 1) for rotating the screw conveyor 18 in the same direction as the bowl but at a different speed. One or more openings 18*a* extend through the wall of the conveyor 18 near the outlet end of the tube 16 so that the centrifugal forces generated by the rotating bowl 12 causes the slurry to gravitate radially outwardly and pass through the openings 18*a* and into the annular space between the conveyor and the bowl 12. The liquid portion of the slurry is displaced to the end 12*b* of the bowl 12 while the entrained solid particles in the slurry settle towards the inner surface of the bowl due to the G forces generated, and are scraped and displaced by the screw conveyor 18 back towards the end 12*a* of the bowl for discharge through a plurality of discharge ports 12*c* formed through the wall of the bowl 12 near its end 12*a*. A plurality of weirs 19*a* (two of which are shown) are provided through the flanged portion of the shaft 19 for discharging the separated liquid. This type of centrifuge is known in the art and, although not shown in the drawings, it is understood that the centrifuge 10 would be enclosed in a housing or casing, also in a conventional manner.

Figure 2:
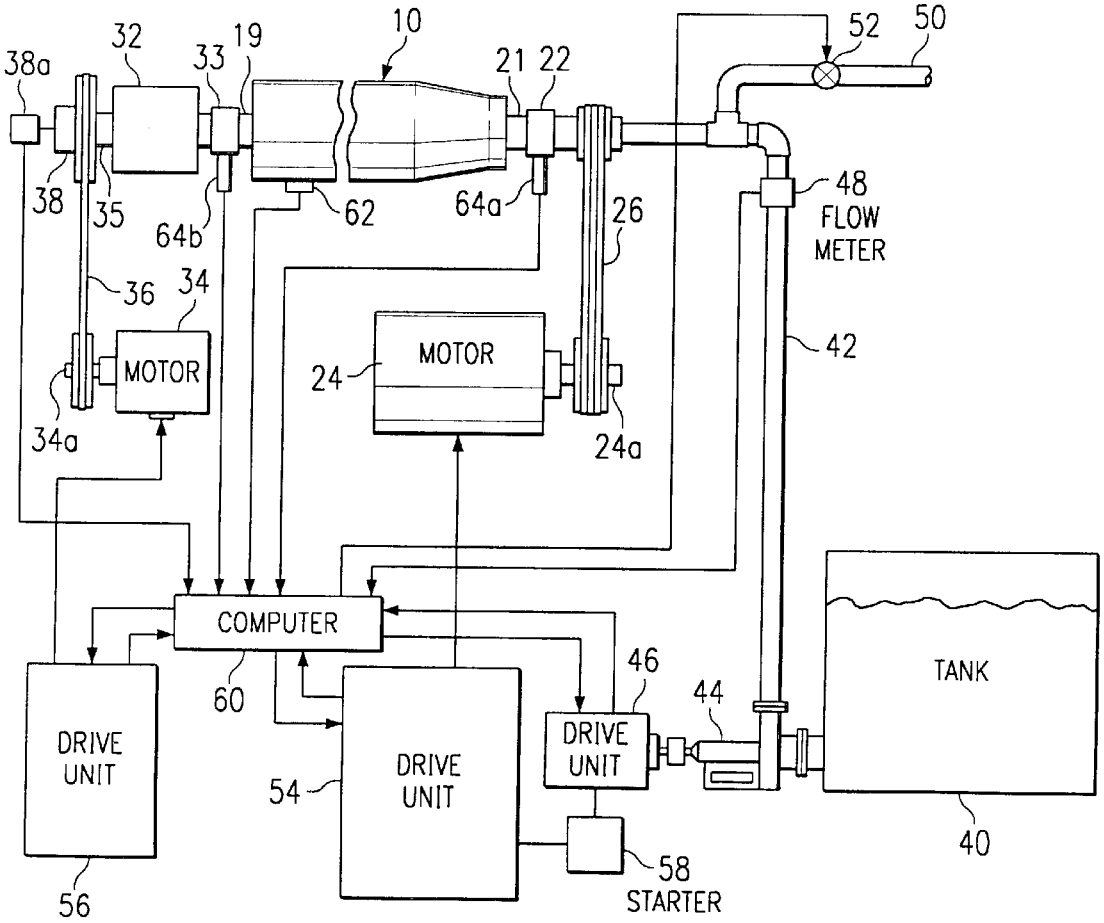
FIG. 2 is a schematic view depicting the centrifuge of FIG. 1 along with its associated components and the control system of the present invention.

Referring to FIG. 2, a drive shaft 21 forms an extension of, or is connected to, the drive flange 14 (FIG. 1) and is supported by a bearing 22. A variable speed AC main drive motor 24 has an output shaft 24*a* which is connected to the drive shaft 21 by a drive belt 26 and therefore rotates the bowl 12 (FIG. 1) of the centrifuge 10 at a predetermined operational speed. The flanged shaft 19 extends from the interior of the conveyor 18 to a planetary gear box 32 and is supported by a bearing 33. A variable speed AC back drive motor 34 has an output shaft 34*a* which is connected to a sun wheel 35 by a drive belt 36 and the sun wheel is connected to the input of the gear box 32. Therefore the motor 34 rotates the screw conveyor 18 (FIG. 1) of the centrifuge 10 through the planetary gear box 32 which functions to establish a differential speed of the conveyor 18 with respect to the bowl 12. A coupling 38 is provided on the shaft of the sun wheel 35, and a limit switch 38*a* is connected to the coupling which functions in a conventional manner to shut off the centrifuge when excessive torque is applied to the gearbox 32.

A tank 40 is provided for receiving and containing the feed slurry being processed, and a conduit 42 connects an outlet opening formed in the lower portion of the tank to the feed tube 16. Although not shown in detail in the drawings, it is understood that an internal passage is formed through the shaft 21 which receives the conduit 42 and enables the feed slurry to pass through the conduit and the feed tube 16 and into the conveyor 18.

A variable frequency drive pump 44 is connected to the conduit 42 and is driven by a drive unit 46, preferably in the form of an electric motor, for pumping the slurry from the tank 40, through the conduit 42 and the feed tube 16, and into the centrifuge 10. A flow meter 48 is connected to the conduit 42 for metering the slurry flow through the conduit, and a conduit 50 registers with the conduit 42 for introducing a dilution agent, such as water or diesel, into the conduit under the control of a valve 52 disposed in the conduit 50. As a result, the viscosity of the slurry can be reduced as needed under conditions to be described.

Two variable speed drive units 54 and 56 are respectively connected to the motors 24 and 34 for driving same at variable frequencies and at variable voltages as dictated by the operational requirements of the system as will be described. The drive unit 54 is also electrically connected to the input of a magnetic starter 58, the output of which is connected to the drive unit 46. The drive unit 54 supplies a control signal to the starter 58 for starting and stopping the drive unit 46, and therefore the pump 44.

A computer 60 is provided which contains computer programs stored on computer-readable media and containing instructions for controlling the operation of the centrifuge 10 and the pump 44. To this end, the computer 60 has several input terminals two of which are respectively connected to the drive units 54 and 56 for receiving data from the drive units, and two output terminals for respectively sending control signals to the drive units. The computer 60 thus responds to the input signals received and controls the drive units 54 and 56 in a manner so that the drive units can continuously vary the frequency and the voltage applied to the respective AC motors 24 and 34 accordingly, to continuously vary the rotation and the torque applied to the drive shaft 21 and to the sun wheel 35, respectively, in a manner to be described.

Another input terminal of the computer 60 is connected to the drive unit 46 for receiving data from the drive unit 46. Another output terminal of the computer 60 is connected to the drive unit 46 for sending control signals to the drive unit 46. The computer 60 thus responds to the input signals received from at least one the drive units 54 and 56 and sends corresponding signals to the drive unit 46 to continuously vary the operation of the pump 44 in a manner to be described.

Another input terminal of the computer 60 is connected to the limit switch 38*a* which provides a signal to the computer in response to excessive torque being applied to the gear box 32. Also, an output signal from the flow meter 48 is passed to an additional input terminal of the computer 60 for downloading information to the unit 60 relating to the flow of the slurry through the conduit 42.

A vibration detector 62 is mounted on the outer surface of the bowl 12 (FIG. 1), is connected to the computer 60, and responds to excessive vibrations of the centrifuge for generating an output signal that causes the computer to send signals to the drive units 54 and 56 to turn off the motors 24 and 34, respectively and therefore shut down the centrifuge 10.

A pair of accelerometer sets 64*a* and 64*b* are connected at or near the bearings 22 and 33, respectively and each set includes two accelerometers for respectively measuring certain operational characteristics of the drive shafts 21 and 20 and their associated bearings. The accelerometer sets 64*a* and 64*b* are connected to the computer 60 for passing their respective output signals to the computer 60 for processing. The accelerometer sets 64*a* and 64*b* can be of the type disclosed in U.S. Pat. No. 4,626,754, the disclosure of which is hereby incorporated by reference. Generally, each accelerometer set includes two or more accelerometers having orthogonal axes that are placed on the frames of the bearings 22 and 33 for detecting vibrations causes by the rotating bowl 12 and screw conveyor 18, as well as the drive shaft 21 and the sun wheel 35. The signals provided by the accelerometers of each set 64*a* and 64*b* are passed to the computer 60 where a computer program contained in the computer analyzes the signals for the presence of specific predetermined frequency signatures corresponding to particular components and their status, which could include a potentially malfunctioning condition. The computer program contained is designed to provide instructions to produce an output in response to any of these frequency signatures being detected, as will be discussed in detail.

The back current to the drive units 24 and 34, are proportional to the loading of the bowl 12 and the conveyor, respectively, the values of which is fed back to the computer 60. The design is such that the pump 44 will be driven by the computer 60 via the drive unit 46 in proportion to back drive currents to one or both of the drives 24 or 34 which correspond to the loading of the bowl 12 and the conveyor 18, respectively. If relatively low back drive currents to the drives 24 and/or 34 occur, the computer 60 will respond to same and send signals to the drive unit 46 to drive the pump 44 at an increased rate. Conversely, if relatively high back drive currents to the drives 24 and/or 34 occur the computer 60 will respond to same and send signals to the motor to drive the pump 44 at a decreased rate.

The computer 60 also receives an input corresponding to the density of the slurry that is pumped from the storage tank 40 to the centrifuge 10, as well as an input from the meter 48 corresponding to the mass rate of the slurry sensed by the meter 48.

Since all of the above-described connections to and from the computer 60 involve conventional electrical connections involving conventional electrical conductors and the like, they will not be described in any further detail. Although not shown, the computer 60 comprises conventional devices including, but not limited to, a processor, a main memory, a mass storage device, a video display, an input device, and an audible signal. Also, several basic electrical components associated with the above-described control system of the present invention are not shown in the interest of brevity. For example, in field applications, a generator would normally be provided which generates electrical power and passes it to a breaker box which distributes the power to the drive units 54 and 56 and to the drive unit 46.

In operation, and with reference to FIGS. 1 and 2, the storage tank 40 receives the slurry, which for the purpose of example, will be assumed to be a mixture of fluid and entrained solid particles. The computer 60 sends an appropriate signal, via the drive unit 54, to the starter 58 which functions to start the drive unit 46 and thus activate the pump 44. The slurry is thus pumped through the conduit 42 and into the interior of the bowl 12 under the control of the computer 60.

The motor 24 is activated and controlled by the drive unit 54 to rotate the drive shaft 21, and therefore the bowl 12, at a predetermined speed. The motor 34 is also activated and driven by the drive unit 56 to rotate the sun wheel 35, and therefore the screw conveyor 18, through the planetary gear box 32, in the same direction as the bowl 12 and at a different speed.

As a result of the rotation of the bowl 12, the centrifugal force thus produced forces the slurry radially outwardly so that it passes through the openings 18*a* in the conveyor and into the annular space between the conveyor and the bowl 12. The fluid portion of the slurry is displaced to the end 12*b* of the bowl 12 for discharge from the weirs 19*a* in the flanged shaft 19. The entrained solid particles in the slurry settle towards the inner surface of the bowl 12 due to the G forces generated, and are scraped and displaced by the screw conveyor 18 back towards the end 12*a* of the bowl for discharge through the discharge ports 12*c*.

The computer 60 receives a signal from the flow meter 48 indicating the flow rate of the slurry entering the centrifuge 10, signals from the drive unit 46 corresponding to the pumping rate of the pump 44, and signals from the drive units 54 and 56 corresponding to torque and speed of the motors 24 and 34, respectively. The computer 60 contains instructions which enables the computer to process the above data and control the drive unit 46 and/or the dilution valve 52 accordingly, to insure that the density of the mixture is within a predetermined acceptable range. For example, the computer 60 will respond to relative high currents on at least one of the drive units 54 and 56 which indicate loading on the conveyor 58 and or the bowl 12, respectively and will send a corresponding signal to the dilution valve 52 to open it and thus cause additional dilution agent to be introduced into the bowl, and/or will send a corresponding signal to the drive unit 46 to reduce the pumping action of the pump 44, as discussed above.

Also, the computer 60 controls the drive units 54 and 56 to vary the frequency and voltage applied to the motors 24 and 34, respectively, as needed to continuously vary the rotational speed of, and the torque applied to, the drive shaft 21 and the sun wheel 35, respectively, to maintain predetermined optimum operating conditions. The computer 60 also monitors the torque applied to the sun wheel 35 from data received from the drive unit 56 and maintains the torque at a relatively high percentage, such as 85%, of the limit of the coupling 38. To this end, in the event one of the above inputs to the computer 60 changes, the computer contains instructions to enable it to change one or more of its output signals to the drive units 54 and 56, the drive unit 46, the starter 58, or the dilution valve 52 to change their operation accordingly. For example, if the screw conveyor 18 (FIG. 1) becomes worn and/or the pump 44, for whatever reason, will not deliver its maximum pumping rate, the computer 60 will compensate by sending the proper signal to the drive unit 54 to increase the speed of the bowl 12, to the drive unit 56 to increase the speed of the conveyor 18, and/or to the drive unit 46 to change the pumping rate of the pump 44. In this context, it can be appreciated that changes in the viscosity of, and particle size distribution in, the slurry will be accommodated by attendant changes in the output control to the drive units 46, 54, and 56 without the need for identifying the particular fluid property changes.

The accelerometer sets 64*a* and 64*b* respond to changes in rotational speed of the drive shaft 21 and the sun wheel 35, and therefore the bowl 12 and the conveyor 18, in terms of frequency, as well as changes in the drive current to the motors 24 and 34 in terms of amplitude which corresponds to load, and generate audible beats corresponding to frequency changes that occur as the loading on the bowl and the conveyor change. These audible beats are processed by the computer 60 and enable the above-mentioned predetermined optimum operating conditions to be attained in a relatively quick manner. More particularly, the loading and unloading of the conveyor 18 caused by the deposition rate of the solids in the bowl 12 and the differential speed of the conveyor 18 cause sonic frequency patterns, or beats. The accelerometers 64*a* and 64*b* will detect these beats and signal the computer 60 which will access this data and compare it to known beats patterns. This will enable the computer 60 to increase or decrease the load on the conveyor 18 without solely relying on the torque of the motor 34 as sensed by the drive unit 56. This type of data interpretation will effect a quicker convergence to proper conveyor loading and would use motor torque in a check and balance convention.

The computer 60 also receives signals from the accelerometer sets 64*a* and 64*b* corresponding to the vibrations generated by the rotating bowl 12 and conveyor 18, as well as their respective drive shafts 21 and 20. The computer 60 processes this information to determine if any anomalies are present causing the vibrations and, if so, the computer generates output signals to adjust the operation of the drive units 54 and 56, the starter 58, and/or the valve 52 accordingly to reduce, if not eliminate, the vibrations. In this context, the computer 60 generates a warning signal indicating the possibility of a malfunction or failure. In addition, if the vibrations are in excess of a predetermined amount, the vibration detector 62 will send an appropriate signal to the computer 60 which, in turn will shut down the centrifuge 10.

In the event the centrifuge 10 become jammed for whatever reason the computer 60 will receive corresponding input signals from the drive units 54 and/or 56 and will send a signal to the starter 58 to turn off the pump 44 and thus cease the flow of the feed slurry to the centrifuge.

It is understood that the present invention is not limited to processing the slurry described above in connection with an oil field drilling operation. For example, it is equally applicable to the treatment of pulp, paper, waste water, mining separation, and food processing.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A centrifuge system for separating liquid and solid particles from a mixture of same, the system comprising a rotatable bowl member for receiving the mixture; a rotatable conveyor member extending in the bowl member; a variable speed pump for pumping the mixture to the bowl member; two drive assemblies for respectively rotating the bowl member and the conveyor member so that the bowl member separates the liquid from the solid particles and the conveyor member conveys the solid particles out of the bowl member; a computer connected to the drive assemblies and to the pump for receiving signals from at least one of the drive assemblies based on the rotation of at least one of the members and for sending corresponding signals to the pump to control the volume of mixture pumped from the pump to the bowl member, the computer also having output terminals connected to the drive assemblies for controlling the drive assemblies; and a flow meter for controlling the flow of the mixture from the pump to the bowl member, the computer being connected to the flow meter for receiving signals from the meter and controlling the signals to the drive assemblies and pump accordingly.

2. The system of claim 1 further comprising a source of fluid for diluting the density of the mixture, and a valve for controlling the admission of the fluid into the bowl member, the computer being connected to the valve for operating same based on the signals received from at least one of the drive assemblies.

3. The system of claim 1 wherein the loading of the conveyor member generates a back drive current to its drive assembly and wherein the computer responds to the current and controls the pump accordingly.

4. The system of claim 3 wherein the computer responds to relatively low back drive currents and controls the pump to increase the amount of mixture pumped to the bowl member.

5. The system of claim 3 wherein the computer responds to relatively high back drive currents and controls the pump to decrease the amount of mixture pumped to the bowl member.

6. A centrifuge system for separating liquid and solid particles from a mixture of same, the system comprising a rotatable bowl member for receiving the mixture; a rotatable conveyor member extending in the bowl member; a variable frequency pump for pumping the mixture to the bowl member; two drive assemblies for respectively rotating the bowl member and the conveyor member so that the bowl member separates the liquid from the solid particles and the conveyor member conveys the solid particles out of the bowl member; a source of fluid for diluting the density of the mixture; a valve for controlling the admission of the fluid into the bowl member; and a computer connected to the drive assemblies and to the valve for receiving signals from at least one of the drive assemblies based on the rotation of, and therefore the load on, the corresponding member, and for sending corresponding signals to the pump and the valve for operating same accordingly; wherein the loading of the conveyor member generates a back drive current to its drive assembly, wherein the computer responds to the current and controls the pump and the valve accordingly, and wherein the computer is connected to the pump for receiving signals from at least one of the drive assemblies based on the rotation of, and therefore the load on, the corresponding member and for sending corresponding signals to the pump for operating same accordingly.

7. The system of claim 6 wherein the computer responds to relatively low back drive currents and controls the pump to increase the amount of mixture pumped to the bowl member.

8. The system of claim 6 wherein the computer responds to relatively high back drive currents and controls the pump to decrease the amount of mixture pumped to the bowl member.

9. The system of claim 6 wherein the computer also has output terminals connected to the drive assemblies for controlling the drive assemblies.

10. The system of claim 9 further comprising a flow meter for controlling the flow of the mixture from the pump to the bowl member, the computer being connected to the flow meter for receiving signals from the meter and controlling the signals to the drive assemblies and pump accordingly.

* * * * *